US009933175B2

(12) United States Patent
Rosen

(10) Patent No.: US 9,933,175 B2
(45) Date of Patent: Apr. 3, 2018

(54) APPARATUS AND METHOD FOR IMPROVED CONTROL OF A MINI SPLIT HVAC SYSTEM

(71) Applicant: Howard Rosen, Montreal (CA)

(72) Inventor: Howard Rosen, Montreal (CA)

( * ) Notice: Subject to any disclaimer, the term of this patent is extended or adjusted under 35 U.S.C. 154(b) by 111 days.

(21) Appl. No.: 15/148,187

(22) Filed: May 6, 2016

(65) Prior Publication Data

US 2017/0321920 A1 Nov. 9, 2017

(51) Int. Cl.
*F24F 11/00* (2018.01)

(52) U.S. Cl.
CPC ..... *F24F 11/0012* (2013.01); *F24F 11/006* (2013.01); *F24F 11/0034* (2013.01); *F24F 11/0086* (2013.01); *F24F 2011/0068* (2013.01); *F24F 2011/0091* (2013.01)

(58) Field of Classification Search
CPC .. F24F 11/0012; F24F 11/0034; F24F 11/006; F24F 11/0086; F24F 2011/0053; F24F 2011/0068; F24F 2011/0091
See application file for complete search history.

(56) References Cited

U.S. PATENT DOCUMENTS 5,010,735 A * 4/1991 Assaf ..... F01K 11/04 60/649
5,117,644 A * 6/1992 Fought ..... F24F 1/06 62/171
9,644,856 B1 * 5/2017 Francis ..... F24F 11/006
2010/0318235 A1 * 12/2010 Moss ..... F24F 11/0086 700/295
2012/0190292 A1 * 7/2012 Skrepcinski ..... F24F 7/007 454/258

FOREIGN PATENT DOCUMENTS

EP 2930444 A2 * 10/2015 ..... F24F 1/0007

* cited by examiner

*Primary Examiner* — Marc Norman
(74) *Attorney, Agent, or Firm* — Hankin Patent Law, APC; Kevin Schraven; Sergio Becerra

(57) ABSTRACT

A controller for a Heating Ventilation or Air Conditioning system (HVAC system) such as a mini split system is disclosed for adding control features that incorporate an observed operational status and occupancy/motion detection utilizing control commands already provided as part of the HVAC system as manufactured.

17 Claims, 4 Drawing Sheets

APPARATUS AND METHOD FOR IMPROVED CONTROL OF A MINI SPLIT HVAC SYSTEM

BACKGROUND OF THE INVENTION

The present invention relates to Heating Ventilation and/or Air Conditioning (HVAC) systems, improving operation of these systems, and providing for improvements in the methods, and/or algorithms used in the management of energy used by these HVAC systems.

Mini Split Air Conditioner systems, also sometimes called ductless split air conditioners, are a common choice component of an HVAC system in the hotel/motel industry. These systems are typically characterized as featuring air-conditioning/heating units incorporating a compressor apparatus separated from an indoor exchanger unit by typically a short distance. The units are efficient and desirable for several reasons such as: 1) they are quiet because the compressor unit is "outside" or some distance away which makes the system quieter; 2) the indoor exchanger unit can be mounted at a selected location inside the room and does not require being mounted through a window; and, 3) more than one exchanger unit can be utilized for a single compressor apparatus. Exchanger units can optionally be hung higher on a wall or in more convenient locations than typical "window" units.

Ductless mini split systems typically include three primary components: a) an outdoor condensing/compressor unit; b) an indoor air exchanger or handler/evaporator; and, c) a conduit housing a power cable, refrigerant tubing and a condensate drain with the conduit connecting the outdoor condensing/compressor unit to the indoor air exchanger unit. The condenser is installed outside the home or structure and the conduit is run from the outdoor condensing unit to individual offices, bedrooms, living rooms, computer/server rooms, basements, or anywhere a controlled temperature is desired. Wall-mounted interior units, (for example indoor air exchanger units) are then placed in the desired spaces to cool or warm air as needed by means of refrigerant flowing between the outdoor and indoor units through tubing in the conduit.

Because it is the noisiest component, the compressor, is installed outside and can be placed some distance away from the indoor unit, ductless mini splits are much quieter than window mounted air conditioners. Additionally, the rumbling ductwork noises often associated with typical, forced air systems are missing in ductless systems.

Unlike bulky window air conditioners which may block outside views, the indoor units of ductless mini splits are compact and stylish and can be mounted high on the wall, out of the way. Since each indoor unit is only responsible for the comfort of one room, it is typically equipped with convenient features like sleep modes and other customizable options to suit individual preferences. Three- to four-inch conduit is also much easier and faster to install than ductwork, reducing overall project costs and allowing more flexibility. A professional HVAC installer can set up a ductless mini split system in just a few hours.

Mini split systems typically provide as an included part of the indoor exchanger unit, an input device for receiving signals from a hand-held remote control device, typically an infra-red handheld remote control. The remote control for the mini-split typically provides a single button for remotely turning the mini-split system on or off, and optional further buttons for adjusting the thermostat setting, and/or fan speed of the mini split HVAC unit.

Some mini split systems, as manufactured, do not have an external thermostat controller that is separated from the indoor exchanger unit apparatus. Other units have a wired thermostat unit which has a disadvantage of requiring wiring to be routed and connected during installation, and may also limit locating the thermostat to places which can be reached by wire.

On some mini splits, the thermostat functionality is incorporated into or is made a part of the indoor exchange unit. This approach has some disadvantage in that placement of the thermostat as part or very near to the indoor exchange unit may not provide for the best location in a conditioned space for a thermostat.

Controllers for mini split HVAC units have not typically incorporated any form of occupancy detection or motion detection into the control apparatus for these units possibly because the indoor exchanger apparatus is often not mounted in an area that has a good "view" of the room.

BRIEF SUMMARY OF THE INVENTION

Mini split systems are very common in facilities for the hotel/motel and/or lodging industry and improving the control of either new installation mini split systems or retrofitting and improving the control of already installed units has potential for improving the economy of operating these units and/or improving the comfort of people that stay in the facilities. It would therefore be an advantage to provide for either retrofit or new installation of the control system of a mini split HVAC system that includes the capability of providing information relating to occupancy detection to be utilized in controlling the HVAC system. It would be a further significant advantage if the improvement in control incorporated the use of wireless components so that the installation using wiring is not required, and also so that occupancy detection apparatus can be placed at a desirable location in the room, either for aesthetics or for providing a good view of the room with regards to detecting motion. It would be a further significant advantage for the controller to utilize an already existing remote control command interface of a previously installed HVAC system, for example using the infra-red command interface already provided for controlling the HVAC system by a hand-held remote control device.

These advantages of retrofit installation would not be necessarily limited to retrofit controllers but would also apply to new or renovation installation with the same advantages of location, no wiring, and an utilization of already existing wireless remote commands to avoid making any modification or alteration of the already manufactured or already installed HVAC system.

Already manufactured HVAC system controllers, as typically provided or available in the industry, have certain limitations that present obstacles in providing for the above improved control features. One of these limitations is that the remote control command interface typically is intended for use by a person that knows what he or she wants to do and who also may have knowledge of the current operating state of the HVAC system. For example, the typical remote control command set includes only a single "power" command to turn an air conditioning exchanger unit on or off, and the person using the remote must observe whether the unit is already on or off before deciding whether to push a button to toggle the current operating state of the exchanger unit. That is, only a single button and only a single command are provided to turn on or off the unit. If the HVAC unit is "off", reception of a "power" command will turn the unit "on". If the unit is already "on", reception of a "power" command from the remote control will turn the unit "off".

In a similar manner, two buttons may be provided on the remote control for adjusting a set-point temperature. Reception of a "temperature up" command will increase the set-point temperature, and reception of a "temperature down" command will decrease the set-point temperature. But the user must have knowledge of the current set-point temperature in order to know whether it is desirable to increase or decrease the set-point temperature. For this purpose, the current set-point may be displayed on an observable display, or there may be no display at all in which case the set-point is simply increased or decreased based on what the user feels or desires.

Thus, providing for reliable control of a mini split system as typically manufactured in the industry presents a particular problem in providing reliable control. Specifically, a problem with controlling a typical mini split or other similar units remotely is that these units receive and react to a single "power command" that tells the unit to turn on if it is off, and off if it is on. That is, receiving a "power command" toggles the power on/off state. Most mini split systems do not provide for reception of a unique command that tells the unit to specifically turn "OFF" or to turn "ON". Thus, an external controller attempting to utilize existing infra-red control commands to turn an HVAC unit on or off does not "know" whether the unit is already on or off, and so it does not know what would be the effect of sending a single infrared "power command". That is, since the controller does not know if the unit is currently "on" or "off" it does not "know" if sending a power command will turn the unit "on" or "off" since the command typically functions just as a "toggle".

One might propose to make a starting assumption that a unit is "off" (or "on") or to "remember" the state of the unit but this is also not reliable because any infrared signal could be briefly or intermittently blocked and therefore reception of any transmitted command would be somewhat unreliable. Further, it would also be possible for a user of the mini split unit to utilize alternate controls directly attached to the unit directly rather than just the remote control device which would change the status of the unit without any notification to the remote "controller".

It would therefore be an advantage in certain illustrated embodiments of the present invention to provide an apparatus and/or method for improved control of a mini split unit in a reliable manner utilizing a means of determining the current state or status of the unit being controlled.

Accordingly, it is a broad object of the present invention to provide for improved operation of an already manufactured Heating Ventilation or Air Conditioning (HVAC) system with improvement(s) including for example: a) utilization of occupancy or activity monitoring in order to provide for energy savings, and b) provision for better locating of a thermostat or a temperature sensor for improved comfort and operating efficiency. Improved operation is provided in one exemplary embodiment of the present invention as an adjunct control unit or device that mounts on a wall above the bed in a hotel or motel room. The adjunct control unit includes a motion sensor or detector which determines occupancy or activity in the room. The adjunct control unit may also optionally include a temperature sensor. The adjunct control unit also includes an operational sensing apparatus which is used to detect or determine the operating state or operating conditions of an already manufactured HVAC system such as a mini split air conditioning exchanger. The adjunct control unit utilizes remote control commands provided as part of the already manufactured air conditioning system so that no modification of the manufactured system is required in order to utilize the adjunct control unit. The adjunct control unit can then for example turn the air conditioning system off when nobody is in the room, and turn it on when someone enters, the turning on or off being accomplished by utilizing the operational sensing apparatus which determines if the air conditioning unit is already running or not, and then which sends a command to "toggle" the operating state as required.

Further, if an optional temperature sensor is included in the adjunct control unit, remote commands can be issued to the manufactured system to force the air conditioning unit to operate as desired, overriding any temperature sensing of the air by the manufactured unit and enabling commands to be issued to increase or decrease the temperature set-point as needed to cause the unit to cool or to heat or to turn the power on or off.

In an embodiment of the present invention, it is therefore an advantage to include an HVAC status detection apparatus comprising a transducer that can detect for example sound, vibration or magnetic field that emanates from the HVAC system when it is in operation. Output from the transducer can then be analyzed to "listen" for sound such as fan or compressor noise from the unit. For example, certain patterns or frequencies of received noise or sound from the mini split indoor exchanger can be "recognized" as being a reliable indicator that the compressor unit is "on", and the absence of such noise being used as a reliable indicator that the compressor unit is "off". Optionally, further analysis of received sound or noise, for example, can also be used to provide an indication as to whether the inside air fan of the HVAC system is on or off. The "transducer" could be a microphone that responds to audible sound, or to lower or higher frequencies outside of a person's audible range. For example, frequencies of vibration around 60 Hertz or below could be recognized as emanating from the HVAC system. The defining of the precise recognition algorithm could be devised by one of ordinary skill in the art of digital signal processing, pattern recognition or other related or applicable fields of engineering. For example, in its simplest form, one could use a series of network of filters or perform a spectrum analysis to identify the different noise frequencies and their respective sources. In general, the transducer can be viewed as an "energy sensor" wherein the energy being sensed is of a type which typically emanates from a HVAC system component such as an indoor air exchanger. This energy emanating from one or more parts of the HVAC system components and sensed by the transducer can be analyzed so as to determine an operating status of the HVAC system, for example whether the compressor is running or not, or as a second example whether the indoor or outdoor fan is running or not.

In another embodiment of the present invention, the "transducer" is implemented as a coil or magnetic induction coil for detecting magnetic field changes. The magnetic induction coil can be optionally located in a position near to one part of the HVAC system such as the indoor exchanger unit, and positioned so as to pick up magnetic signals emanating from the indoor exchanger unit which are indicative of the HVAC system's state of operation. Other transducers or detection mechanisms not requiring modification of an existing designed or installed HVAC system could also be devised by one of ordinary skill in the art of electronic design.

It will be noted that an "analysis" of a signal from a transducer may depend on the type of transducer signal and whether, for example, it produces a digital or an analog output. In general, it is desirable that the design of an analysis circuit or processing algorithm allows or covers various models or models made by various manufacturers of the HVAC system being analyzed/controlled. It may be helpful, but not necessary, to provide input to the analysis circuitry or programming circuitry that describes the type of HVAC unit, or even more specifically a manufacturer name or model number. It may be also desirable that the analysis or programming circuitry be programmed during installation or designed to be self-programming by allocating a plurality of time intervals during which it can receive data indicating that the HVAC system is operating in one mode or another, and from analysis of the received signals during those time intervals to determine the different operating states of the HVAC system.

It is therefore an added improvement that the controller when powered-on be made to perform a periodic test which determines the characteristics or characterizes the start-up sounds and/or shut-down sounds emitted or occurring during other operating modes from the HVAC (or exemplary mini split) system. Output signals from the microphone or other sound, vibration or magnetic field detection apparatus or device are analyzed or compared with such start-up sounds to determine the current state of the mini split unit such as, whether it is powered on or powered off, whether it is providing for conditioning of the air, whether the fan is on or off, and/or the speed of the fan. This analysis also could be used to determine other details about the current operative state of the unit such as compressor speed, compressor loading etc. The transducer or microphone may also provide for added benefit in increasing accuracy of occupancy detection. The microphone may also be used to provide detailed information useful in performing the analysis of such information which has potential for improving the management of energy used by the HVAC system while still providing comfort to the room's occupants.

It is of further advantage in controlling the mini split system to be able to observe or record temperature responses to either intended commands or to test commands to determine, for example, whether the mini split system is in a "heating" or "cooling" mode.

In a first illustrated embodiment that incorporates the teachings of the present invention, a motion detector is incorporated into an add-on control of an HVAC system such as a mini split air conditioning or heating system. The motion detector, conventional in design, is used to provide information relating to occupancy in a room or space served by an HVAC system. The motion detector can also be used to provide information relating to a level of activity of one or more occupants in a room or space served by an HVAC system. Incorporating information regarding occupancy or level of activity is well known in the art for improving comfort and/or reducing energy use in operation of HVAC equipment. A basic implementation for example may provide for simply turning off all heating or cooling when motion has not been detected in a conditioned space for some period of time, such as for example 15 minutes.

Occupancy or motion detectors can also be used to both improve comfort and/or save conditioning costs by detecting a level of activity in the room and adjusting conditioning settings based on the currently detected level of activity, a pattern of activity, or a past recorded pattern of activity. Additionally, time of day apparatus is another device feature that can be used to provide information for improving comfort and providing energy savings.

It is also noted that occupancy detectors generally utilize a motion detector device that incorporates an infra-red motion detector to detect when people are moving in the room or area. In facilities such as hotels and/or motels, it is particularly beneficial to have the occupancy detector mounted in a location in the room that provides a good view of the bed in a hotel or motel room because people may be moving only slightly while sleeping and thus it is important to be able to detect even small movement in the area of a bed to maintain accuracy in detecting occupancy.

It would be useful to provide apparatus and/or methodology for reliably controlling a typical mini split HVAC system from a remote device, the remote device optionally including apparatus for sensing temperature in the room or area. A further improvement is to have such control apparatus to include occupancy/motion sensing apparatus.

It would be a further benefit if the temperature and/or occupancy detection are provided by the control apparatus without requiring additional "hard" wiring to the mini split's indoor exchange unit, its control, or to the external unit which includes a compressor. It would be a further added benefit if hard wiring for power is also not needed. Also, it would be a further benefit for the control apparatus to utilize infra-red control means/apparatus for communication with the mini split indoor exchange apparatus with the infrared capability utilized that is already a part of a typical mini split control system when control capability is provided by an infra-red remote or infrared commands already present as part of the mini split system. That is, using the same infrared control commands (or command set) already included as the mini split unit was manufactured and not requiring modification to the mini split system or its control apparatus.

It is to be noted that the discussion of use of infrared controllers is exemplary, and that remote control devices for remote control of an HVAC system could also use radio signals, visible light signals, or any other form of wireless communication. It would also be possible to use a "Wi-Fi" network to relay commands from a remote control device to the HVAC system. These implementations could be readily designed by one of ordinary skill in the state of the art of electronic design and do not in any way depart from the broad principles or teachings of the present invention.

It is of particular advantage to enable the placement of an occupancy or motion detector over a bed or in the bed area. It is noted that a typical thermostat in a hotel or motel room may not be located just over the bed, or even in the same area as the bed. It might be located in a convenient location on a wall near the entrance to a room, or in an area near where return air would pass.

In one illustrated embodiment of the present invention, a remote thermostat apparatus used for controlling a mini split Heating, Ventilation, and/or Air Conditioning (HVAC) system incorporates a temperature sensing apparatus, a microphone, sound analysis apparatus and control for such analysis, an overall control apparatus, and an infrared sending apparatus. Optionally, user input apparatus may be provided to enable a user to set options such as a desired temperature, the speed of the fan, and/or whether heating or cooling is desired. Communication apparatus may optionally be included to communicate with a central system which provides temperature settings and/or other information as typical of a central HVAC control system. The communication apparatus may be constructed to have the remote thermostat apparatus made a part of a mesh network which communicates with other remote thermostat apparatus or a centralized control system.

In a second illustrated embodiment of the present invention, the remote thermostat apparatus of the first illustrated embodiment further incorporates a motion or occupancy sensing apparatus, the occupancy sensing apparatus providing for improved control of the mini split system so as to enhance the comfort of occupants in the conditioned area or space, and/or to provide for energy savings based upon adjusting the control of the mini split system as a function of a condition of occupancy and/or movement in the conditioned area or space/room (the "room" being the area observed by the occupancy sensing apparatus).

The control apparatus or thermostat apparatus in the above embodiments can also provide in place of, or in addition to motion sensing or temperature sensing apparatus, further conditioning requirements such as a measure of humidity. For example, in another embodiment of the present invention, one or more signals from a humidity sensor are used to determine a need for sending control commands to an HVAC system. A transducer is used to capture a signal from the HVAC system; the transducer signal is then analyzed to determine the current operating state of the HVAC system, and based upon such current operating state of the HVAC system, commands are sent utilizing an infra-red transmitter, for example, to change the operation of the HVAC system so as to change, influence or attempt to move the measured humidity in the conditioned space closer to a previously defined value for the measured humidity.

It is noted that although the present invention is first directed toward improvement in operation of HVAC systems commonly called "mini splits" that practice of the invention is not in any way restricted to the controlling of precisely that type or model of HVAC system or air conditioner. The teachings of the present invention can be utilized with any system that incorporates the remote control of an existing HVAC system using an infra-red transmitter, the infra-red transmitter being utilized by the system to send infra-red signals which in turn control features of the HVAC system. Examples of such features include power commands, set-point temperature adjustments, fan speed etc. One primary feature of the invention in certain illustrated embodiments is the determination of the HVAC system's present operating status with regards to one or more features utilizing input from a microphone or sound, vibration or magnetic field detection apparatus.

It is also noted that certain elements of the present invention could be implemented as hardware, software, or as firmware components or a combination of such as a matter of design choice, and that description of any specific implementation does not imply that a specific or limiting approach is to be followed. The description is exemplary in describing one or more illustrated embodiments, and alternatives could be readily determined or designed by one skilled in the art.

BRIEF DESCRIPTION OF THE SEVERAL VIEWS OF THE DRAWING

The invention will be better understood by means of the following description, given only as an example and in reference to the attached drawings. Other advantages, purposes and characteristics of the present invention will emerge from the following detailed description and with reference to the attached drawings, in which.

DETAILED DESCRIPTION OF THE SEVERAL VIEWS OF THE DRAWING

Figure 1:
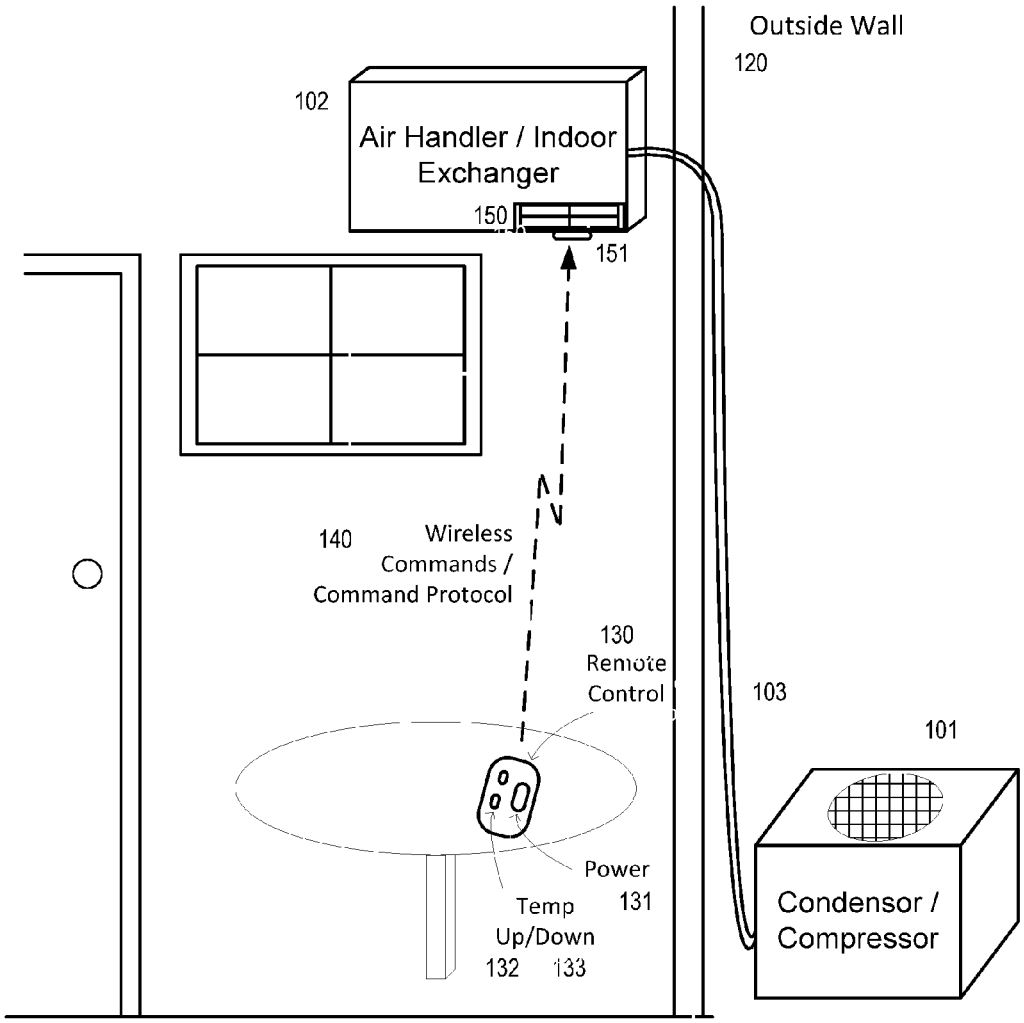
PRIOR ART FIG. 1
FIG. 1 illustrates a prior art ductless mini split HVAC system.

It is noted that while a mini split system as depicted in FIG. 1 is an example of a prior art system to which the teachings of the present invention may be applied, the mini split system is shown only as an illustrative example and the concepts and all aspects of the present invention can be applied to types or models of HVAC systems. It is also noted that application of the teachings of the present invention is not necessarily just for applications requiring heating and/or cooling but could be applied to any type of conditioning of air in a room or supplied to a room or any conditioned space. That is, the figures depicted in this drawing are meant to be interpreted in a broad and general fashion.

FIG. 1 illustrates a prior art ductless mini split HVAC system. In FIG. 1 a condenser 101 unit is illustrated as being located outside of a building, and would typically include a compressor for heating and/or cooling. A conduit 103 is shown for passing or containing a Freon line and/or control connections through an outside wall 120 of the building to a second unit mounted inside the space or room to be conditioned, that second unit being illustrated as an Air Handler or Indoor Exchanger unit 102. The HVAC system as manufactured includes the condenser unit 101, the air handler/indoor exchanger 101 and also typically includes, as part of the indoor exchanger unit, an HVAC system control module 150 and a remote control receiver 151, the remote control receiver 151 for receiving wireless commands 140 transmitted from a remote control device 130, the wireless commands 140 typically including commands for signaling toggling of the power condition and increasing or decreasing the temperature set-point. These commands are transmitted by the remote control unit 130 when a power button 131, a temperature up button 132 or a temperature down button 133, respectively are pushed by a user of the system. The command protocol utilized over the wireless connection 140 is predefined by the manufacturer of the HVAC system.

As previously discussed, it is one broad object of the present invention to provide a method and/or apparatus that allows for adding an adjunct control unit to the air conditioning/heating and or cooling system illustrated in FIG. 1 so as to add to the overall control of the HVAC system, a feature or capability of utilizing a motion detector to determine an occupancy condition and optionally a history of room occupancy. In one illustrated embodiment, the present invention provides a method and apparatus for accomplishing this objective without additional wiring be added to the existing HVAC system, and while utilizing the existing wireless command protocol over the wireless connection 140, and further without requiring any or insignificant modification of the existing illustrated HVAC system.

Figure 2:
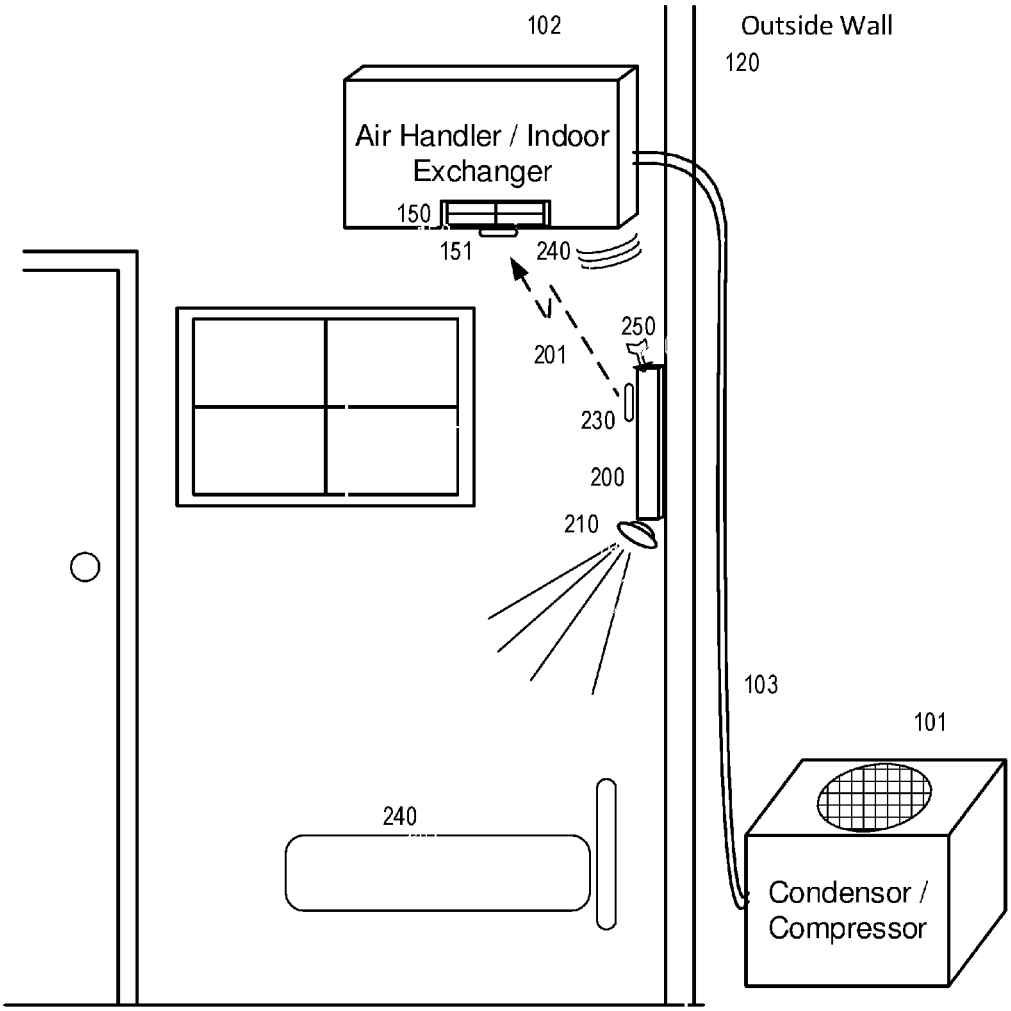
FIG. 2 illustrates an adjunct HVAC control apparatus that incorporates motion or occupancy detector apparatus, a wireless transmitter for transmitting wireless commands to a main HVAC control apparatus, the main HVAC control apparatus being already provided as part of the HVAC system as manufactured, and a vibration or sound sensing transducer for use in the adjunct control apparatus in determining a current operating state of the HVAC system.

FIG. 2 illustrates an adjunct HVAC control apparatus 200 that incorporates a motion or occupancy detector apparatus 210. The motion or occupancy detector 210 is intended to be located at a location in the conditioned space or room that provides a good view of activity in the room or space. In this illustration, the motion detector 210 is located so as to point at a bed in the room, the bed being located in an area where a person when sleeping may not move very much and the ability of detecting movement is best served by locating the motion detector 210 in a place which has a good view of the bed area. The adjunct control apparatus 200 further incorporates a wireless transmitter 230 for transmitting wireless commands to a main HVAC control apparatus 150, the main HVAC control apparatus 150 being originally provided as part of the HVAC system as manufactured, and a vibration, sound or magnetic field sensing transducer 250 for use in the adjunct control apparatus 200 in determining a current operating state of the HVAC system, and typically and more specifically the status of the Air Handler/indoor exchanger unit 102, and/or the condenser/compressor unit 101. Specifically in FIG. 2, the already existing control module 150 and the already existing wireless receiver 151 and the command protocol over the wireless connection 140 are not changed from that prior art system shown in FIG. 1. It is noted that the transducer 250 optionally can receive and the adjunct control module can analyze sound and vibration that may emanate from either the condenser unit 101 and/or the air handler unit 102. This choice of unit is one that can be made by a designer or engineer of ordinary skill in the art of designing the control algorithms and the sound/vibration signal analysis programs, method or apparatus.

Figure 3:
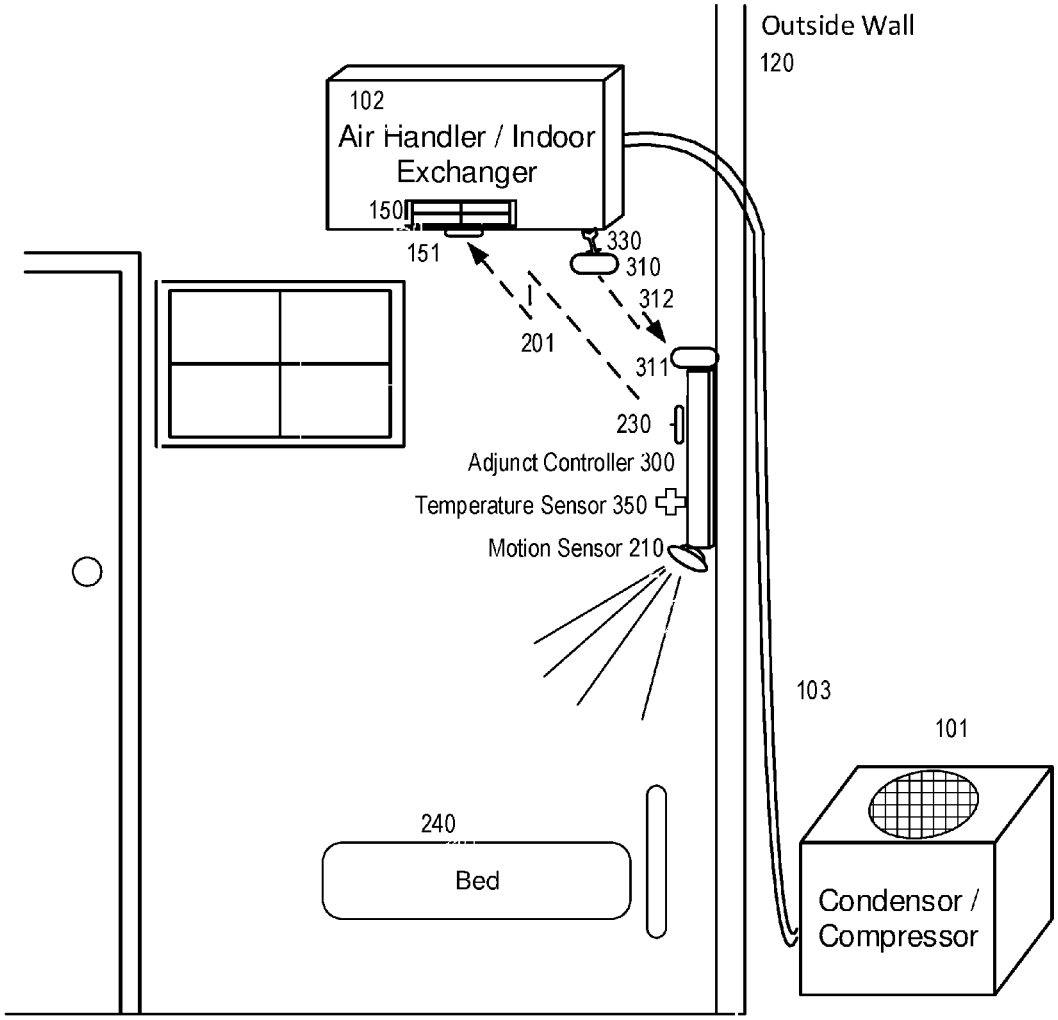
FIG. 3 illustrates an adjunct HVAC control apparatus that incorporates a temperature sensing apparatus, a wireless transmitter for transmitting wireless commands to a main HVAC control apparatus, the main HVAC control apparatus being included as part of the HVAC system as manufactured, and a vibration or sound sensing transducer used in the adjunct control apparatus in determining a current operating state of the HVAC system; and, FIG. 4 illustrates an adjunct HVAC control apparatus that incorporates motion or occupancy detector apparatus, a wireless transmitter for transmitting wireless commands to a main HVAC control apparatus, the main HVAC control apparatus being included as part of the HVAC system when manufactured, and a vibration or sound sensing transducer used in the adjunct control apparatus in determining a current operating state of the HVAC system, and a connection or wiring mechanism that enables the vibration or sound sensing transducer to be placed remotely from the rest of the adjunct HVAC control apparatus, thus enabling the transducer to be mounted attached to the indoor exchanger unit or very close to it.

FIG. 3 illustrates an adjunct HVAC control apparatus 300 that is similar to the adjunct control apparatus 200 shown in FIG. 2. The adjunct HVAC control apparatus of FIG. 3 incorporates a temperature sensing apparatus 350, a wireless transmitter for transmitting wireless commands to a main HVAC control apparatus 150, the main HVAC control apparatus being already provided as part of the HVAC system as manufactured, and a vibration or sound sensing transducer 330 for providing an output transducer signal to be transmitted to the adjunct controller 300 by a wireless transmitter 310 which in turn provides a wireless signal 312 to a wireless receiver 311 that is used by the adjunct control apparatus 300 in determining a current operating state of the HVAC system. It is noted that interpretation an analysis of the signal can be performed by analysis processing apparatus or included either before the wireless transmitter/receiver combination, or after. That is, the analysis processing apparatus is located near to the air handler, or near or within the adjunct controller 300. It is further noted that additional processing or circuitry may be required to be located between the transducer 330 and the wireless transmitter 310 for preserving transmission quality and this can be readily determined, designed or included by one of ordinary skill in the art of electronic design engineering.

Figure 4:
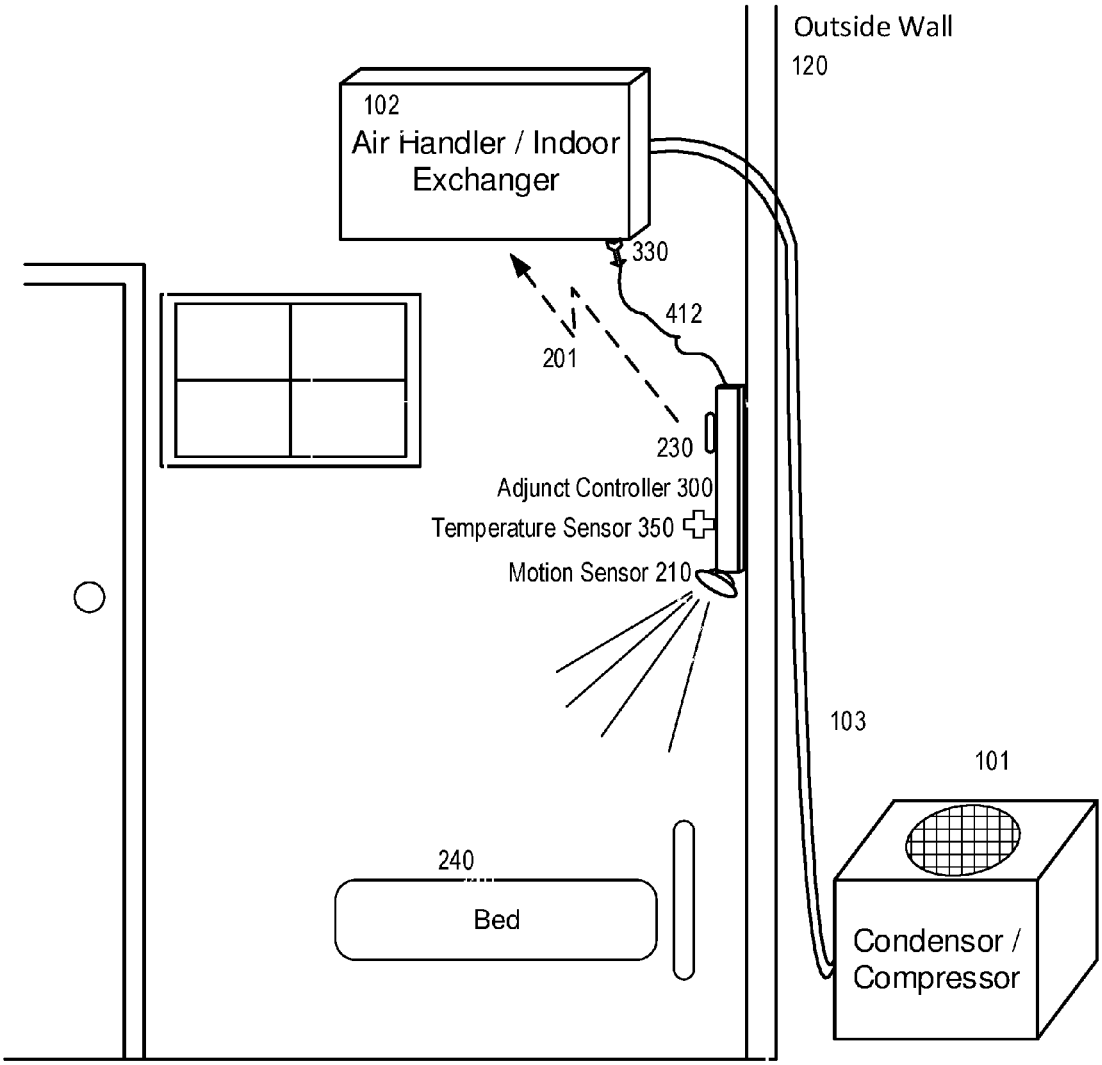

FIG. 4 illustrates an adjunct HVAC control apparatus that incorporates a motion or occupancy detector apparatus 210, a wireless transmitter 230 for transmitting wireless commands 201 to a main HVAC control apparatus, the main HVAC control apparatus being already provided as part of the HVAC system as manufactured and typically comprising an outdoor condenser/compressor 101, an indoor air handler/exchanger 102 and refrigerant/control connections 103. The adjunct controller 300 further includes a vibration or sound sensing transducer 330 used by the adjunct control apparatus 300 in determining a current operating state of the HVAC system, and a connection or wiring mechanism 412 that enables the vibration or sound sensing transducer to be placed remotely from the rest of the adjunct HVAC control apparatus 300 thus enabling the transducer 330 to be mounted or attached to the indoor exchanger unit 102 or very close to it.

Thus, while the principles of the invention have now been made clear and described relative to a number of illustrative embodiments or implementations, it will be immediately obvious to those skilled in the art the many modifications or adaptations which can be made without departing from those principles. While the invention has been shown and described with reference to specific illustrated embodiments, it should be understood by those skilled in the art that various changes in form and detail may be made such implementations without departing from the spirit and scope of the teachings of the invention as defined by the following claims.

Having described the illustrated embodiments of the present invention, it will now become apparent to one of skill in the arts that other embodiments or implementations incorporating the teachings of the present invention may be used. Accordingly, these embodiments should not be limited to the disclosed embodiments or implementations but rather should be limited only by the spirit and scope of the following claims.

What is claimed is:

1. An adjunct control apparatus for controlling a Heating Ventilation and Air Conditioning (HVAC) system that is used for conditioning air in a conditioned space, the adjunct control apparatus including an apparatus for determining control requirements for the HVAC system in order to provide desired conditioning of the air in the conditioned space, the adjunct control apparatus further comprising:

A) a control module that provides overall control of the adjunct control apparatus and;

B) a wireless transmitter operatively coupled to the control module for sending wireless commands from the adjunct control apparatus to the HVAC system; and, C) a transducer for capturing activity based energy emanating from the HVAC system, the transducer being operatively coupled to the control module for providing a transducer signal that is analyzed by the control module to determine a current operating status of the HVAC system; and, the control module configured to cause the wireless transmitter to send wireless command signals to the HVAC system, the wireless command signals sent being based upon both: a) the determined control requirements for the HVAC system, and b) the determined current operating status of the HVAC system.

2. The adjunct control apparatus of claim 1 further including a motion sensing apparatus operatively coupled to the control module which provides a signal indicative of motion in the conditioned space to the control module; the signal indicative of motion in the conditioned space being utilized by the control module to make a determination of a condition of occupancy in the conditioned space, and the wireless command signals sent being further based upon the condition of occupancy in the conditioned space.

3. The adjunct control apparatus of claim 2 wherein the transducer comprises a magnetic field detection apparatus.

4. The adjunct control apparatus of claim 2 wherein the transducer comprises a microphone.

5. The adjunct control apparatus of claim 1 further including a current temperature sensing apparatus operatively coupled to the control module which provides a signal directly related to a measured current room temperature in the conditioned space to the control module; and, the wireless command signals sent by the control module being further based upon the measured current room temperature.

6. The adjunct control apparatus of claim 1 further including a current humidity sensing apparatus operatively coupled to the control module which provides a signal directly related to a measure of humidity in the conditioned space to the control module; and, the wireless command signals sent by the control module being further based upon the measure of humidity in the conditioned space.

7. The adjunct control apparatus of claim 1 further including a transducer connecting wire for connecting the transducer to the control module and for enabling the transducer to be mounted at a location remote from the control module.

8. The adjunct control apparatus of claim 7 further including a transducer mounting apparatus that enables the transducer to be attached to an exchanger unit included as a part of the HVAC system.

9. The adjunct control apparatus of claim 1 further including wireless transducer connection apparatus that operatively couples the transducer to the control module and enables the transducer to be mounted at a location remote from the control module.

10. The adjunct control apparatus of claim 9 further including a transducer mounting apparatus that enables the transducer to be attached to an exchanger unit included as a part of the HVAC system.

11. The adjunct control apparatus of claim 1 further comprising digital signal processing apparatus coupled to the control module, the digital signal processing apparatus performing an analysis of the transducer signal in determining the current operating status of the HVAC system.

12. The adjunct control apparatus of claim 1 wherein the transducer comprises a magnetic field detection apparatus.

13. The adjunct control apparatus of claim 1 wherein the transducer comprises a microphone.

14. An adjunct control apparatus for enhanced control of a Heating Ventilation and Air Conditioning system (HVAC system), the adjunct control apparatus comprising:

A) a control module;

B) a motion sensing apparatus operatively coupled to the control module;

C) a wireless transmitter operatively coupled to the control module for sending wireless commands from the adjunct control apparatus to the HVAC system; and, D) a transducer for detecting sound, vibration or electromagnetic signals emanating from the HVAC system, the transducer operatively coupled to the control module and providing a signal that is analyzed by the control module to determine a currently detected operating status of the HVAC system; and, the control module in response to signals from the motion sensing apparatus being operative to send wireless command signals by the wireless transmitter to the HVAC system, the wireless command signals sent by the wireless transmitter being determined based in part upon the currently detected operating status of the HVAC system.

15. A method for controlling a Heating Ventilation and Air Conditioning system (HVAC system) from an adjunct control apparatus, the method comprising the following steps:

A) with apparatus that is included as part of the adjunct control apparatus determine a desired change in operating state of the HVAC system;

B) utilizing a transducer to generate a transducer signal and then analyzing the transducer signal to determine a current operating state of the HVAC system;

C) using processing apparatus further included in the adjunct control apparatus to determine a specific command signal to be sent to the HVAC system, the specific command signal based upon both: a) the current operating state of the HVAC system; and, b) the desired change in operating state of the HVAC system; and, D) transmitting that specific command signal to the HVAC system utilizing a wireless transmitter included as part of the adjunct control apparatus.

16. The method of claim 15 further including the step of utilizing a motion sensing apparatus included in the adjunct control apparatus to produce a motion sensor signal which is used in making a determination of conditioned space occupancy status, and further utilizing the determined conditioned space occupancy status in the determining of the specific command signal to be sent to the HVAC system.

17. The method of claim 15 wherein the specific command signal sent to the HVAC system causes a current temperature of air in the conditioned space to be moved closer to a currently desired temperature in the conditioned space.

* * * * *